United States Patent [19]

Nakayama et al.

[11] 4,381,429

[45] Apr. 26, 1983

[54] DISTRIBUTOR FOR AN INTERNAL COMBUSTION ENGINE CONTAINING AN APPARATUS FOR SUPPRESSING NOISE

[75] Inventors: Haruhiko Nakayama; Masahiko Nagai; Minoru Yano, all of Toyota, Japan

[73] Assignee: Toyota Jidosha Kogyo Kabushiki Kaisha, Aichi, Japan

[21] Appl. No.: 261,610

[22] Filed: May 7, 1981

[30] Foreign Application Priority Data

Sep. 22, 1980 [JP] Japan ..... 55-130588

[51] Int. Cl.[3] ..... H01H 19/00

[52] U.S. Cl. ..... 200/19 R; 123/633; 200/19 DR

[58] Field of Search ..... 200/19 R, 19 A, 19 DR, 200/19 DC; 123/633

[56] References Cited

U.S. PATENT DOCUMENTS

| | | | |
|---|---|---|---|
| 2,227,972 | 1/1941 | Hood et al. | 200/19 A |
| 3,949,721 | 4/1976 | Hori et al. | 200/19 R |
| 4,007,342 | 2/1977 | Makino et al. | 200/19 R |
| 4,039,787 | 8/1977 | Hori et al. | 200/19 R |

FOREIGN PATENT DOCUMENTS

| | | |
|---|---|---|
| 48-12012 | 4/1973 | Japan . |
| 51-38853 | 10/1976 | Japan . |
| 52-15736 | 5/1977 | Japan . |
| 52-15737 | 5/1977 | Japan . |

*Primary Examiner*—J. R. Scott

*Attorney, Agent, or Firm*—Stevens, Davis

[57] ABSTRACT

A distributor containing an apparatus for suppressing noise is disclosed. The distributor is comprised of a rotor, a plurality of stationary terminals and a hollow insulating member which is introduced into a discharging air gap formed between a discharging electrode of the rotor and each of discharging electrodes of the stationary terminals. The hollow insulating member has an arc-shaped discharging portion at one open end thereof, the other open end thereof is connected to the discharging electrode of the rotor. Thereby, a spark discharge, occurring between the discharging electrodes of the rotor and each said stationary terminal, is generated via a through hole formed inside the hollow insulating member and the arc-shaped discharging portion.

9 Claims, 11 Drawing Figures

DISTRIBUTOR FOR AN INTERNAL COMBUSTION ENGINE CONTAINING AN APPARATUS FOR SUPPRESSING NOISE

BACKGROUND OF THE INVENTION

The present invention relates generally to an apparatus for suppressing noise which radiates from the ignition system of an internal combustion engine, and more particularly relates to an apparatus for suppressing noise which generates from the distributor located in the ignition system.

The igniter in which an electric current has to be intermitted quickly in order to generate a spark discharge, radiates the noise which accompanies the occurrence of the spark discharge. It is well known that the noise disturbs radio broadcasting service, television broadcasting service and other kinds of radio communication systems and, as a result, the noise deteriorates the signal-to-noise ratio of each of the above-mentioned services and systems. Further, it is very important to know that the noise may also cause operational errors in electronic control circuits, mounted in vehicles, such as E.F.I. (electronic controlled fuel injection system), E.S.C. (electronic controlled skid control system) or E.A.T. (electronic controlled automatic transmission system), and, as a result, traffic safety may be threatened. On the other hand, the tendency for an electric current, flowing in the igniter to become very strong and to be intermitted very quickly in order to generate a strong spark discharge, becomes a common concept because of the increasing emphasis on clean exhaust gas. However, strong spark discharge is accompanied by extremely strong noise which aggravates the previously mentioned disturbance and operational errors.

For the purpose of suppressing the noise, various kinds of apparatuses or devices have been proposed. A first prior art example is provided by the Japanese Patent Publication No. 48-12012. In the first prior art example, the spark gap, between the electrodes of the distributor rotor and the stationary terminal in the distributor, is selected to be between 1.524 mm and 6.35 mm, which is wider than the spark gap used in the typical distributor. A second prior art example is provided by the Japanese Patent Publication No. 51-38853. In the second prior art example, an electrically high resistive layer is formed on each of the surfaces of the electrodes of the distributor rotor and/or the stationary terminals. A third prior art example is provided by the Japanese Patent Publication No. 52-15736. In the third prior art example, an electrically resistive member is inserted in the spark gap formed between the distributor rotor and the stationary terminal, and the spark discharge occurs between the distributor rotor and the stationary terminal, through said electrically resistive member. A fourth prior art example is provided by the Japanese Patent Publication No. 52-15737. In the fourth prior art example, a dielectric member is inserted in the spark gap formed between the distributor rotor and the stationary terminal, and the spark discharge occurs between the distributor rotor and the stationary terminal by way of the surface of said dielectric member.

Thus, the distributor, which incorporates either one of the above-mentioned first through fourth prior art examples, can exhibit remarkable suppression of the noise, when compared to the conventional distributor which contains no apparatus for suppressing the noise. Thereafter, the inventors have advanced further development on the apparatus for suppressing the noise, and finally succeeded in realizing the apparatus which is superior to any one of said prior art examples in suppressing the noise of the distributor. The developed distributor is characterised in that the distributor is comprised of a rotor and a plurality of stationary terminals, wherein a hollow insulating member is introduced into a discharging air gap formed between a discharging electrode of the rotor and each of the discharging electrodes of the stationary terminals, and thereby, a spark discharge, occurring between the discharging electrodes of the rotor and each said stationary terminal, is generated via through hole formed inside the hollow insulating member.

However, in the developed distributor having the hollow insulating member, improvement on a so-called advance angle has not yet been fully examined, which improvement resides in the fact that it should actually be very easy for the spark discharge to follow within a wide range of a variation of the advance angle by which the ignition timing of each spark plug is defined. In achieving such improvement, it must be taken into consideration that the hollow insulating member must be easily manufactured and also be low in cost. At the same time, on the other hand, the capability for igniting the fuel air mixture must not be weakened due to the presence of the hollow insulating member.

SUMMARY OF THE INVENTION

Therefore, it is an object of the present invention to provide an apparatus, for suppressing noise, which is easily manufactured, low in cost and also is able to follow within a wide range of a variation of the advance angle without lowering the capability for igniting the fuel air mixture.

BRIEF DESCRIPTION OF THE DRAWINGS

The present invention will be more apparent from the ensuing description with reference to the accompanying drawings wherein.

DETAILED DESCRIPTION OF THE INVENTION

Figure 1:
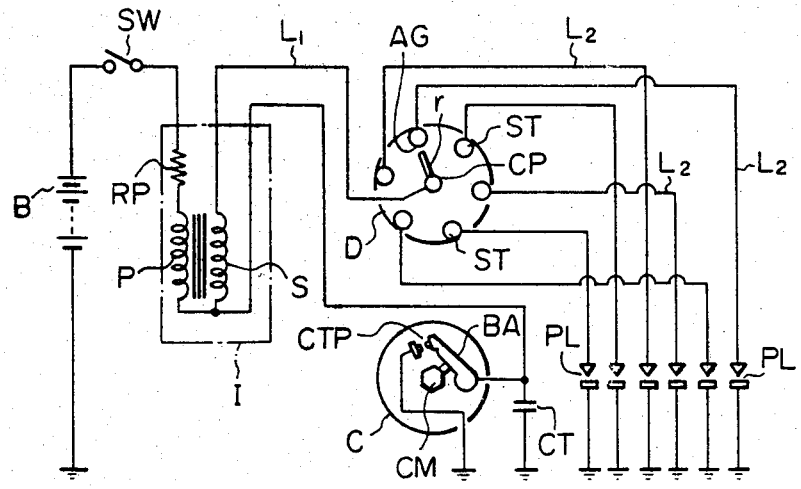
Fig. 1 (PRIOR ART)
FIG. 1 is a typical conventional wiring circuit diagram of an igniter.

FIG. 1 is a typical and conventional wiring circuit diagram of the igniter, the construction of which depends on a so-called battery type ignition system. In FIG. 1, a DC current which is supplied from the positive terminal of a battery B flows through an ignition switch SW, a primary resistor RP of an ignition coil I, a primary winding P thereof and a contact breaker C, to the negative terminal of the battery B. The contact breaker C is comprised of a cam CM which rotates in synchronization with the rotation of a driving shaft (refer to DS of FIG. 2) of the internal combustion engine, a breaker arm BA which is driven by the cam CM and a contact point CTP which acts as a switch being made ON and OFF by cooperating with the breaker arm BA. A symbol CT denotes a capacitor which functions as a spark quenching capacitor for absorbing the spark current flowing through the contact point CTP. When the contact point CTP opens quickly, the primary current suddenly stops flowing through the primary winding P. At this moment, a high voltage is electromagnetically induced through a secondary winding S of the ignition coil I. The induced high-voltage surge is transferred through a primary tension cable $L_1$ and applied to a center piece CP which is located in the center of the distributor D. The center piece CP is electrically connected to the distributor rotor r which rotates within the rotational period synchronized with said driving shaft (refer to DS of FIG. 2). Six stationary terminals ST, assuming that the engine has six cylinders, in the distributor D, are arranged with the same pitch along a circular locus which is defined by the rotating electrode of the rotor r, maintaining a discharging air gap AG between the electrode and the circular locus. The induced high-voltage surge is further fed to the stationary terminals ST through said air gap AG every time the electrode of the rotor r comes close to one of the six stationary terminals ST. Then the induced high-voltage leaves one of the terminals ST and further travels through a secondary high tension cable $L_2$ to a corresponding spark plug PL, where spark discharges occur sequentially in the respective spark plugs PL and ignite the fuel air mixture in the respective cylinders.

It is a well-known phenomenon that noise is radiated with the occurrence of a spark discharge. As can be seen in FIG. 1, three kinds of spark discharges occur at three locations in the ignitor. A first spark discharge occurs at the contacts (BA, CTP) of the contact breaker C. A second spark discharge occurs at the air gap AG between the electrode of the rotor r and the electrode of the terminal ST. A third spark discharge occurs at the spark plug PL.

It is a well-known fact that, among the three kinds of spark discharges, the above-mentioned second spark discharge radiates the strongest noise compared with the remaining spark discharges. That is, the spark discharge which occurs between the electrode of the rotor r and the electrode of the stationary terminal ST, in the distributor D, radiates the strongest noise.

Figure 2:
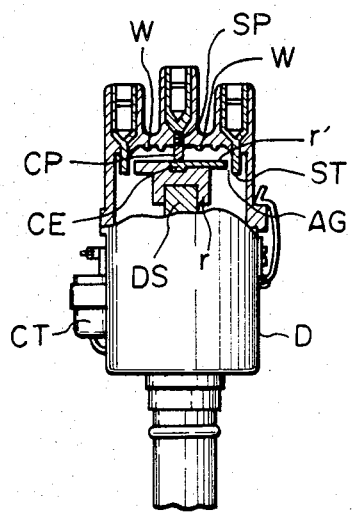
Fig. 2 (PRIOR ART)
FIG. 2 is a side view, partially cut off, showing a typical conventional distributor "D" shown in FIG. 1.

FIG. 2 is a side view, partially cut off, showing an actual construction of the typical conventional distributor D shown in FIG. 1. In FIG. 2, the members, which are represented by the same reference symbols as those of FIG. 1, are identical to each other. A center electrode CE is located at the center of the rotor r and contacts with a center piece CP which is urged to the electrode CE by means of a spring SP. The rotor r is rotated by the driving shaft DS and distributes the above-mentioned high-voltage surge sequentially to each of the stationary terminals ST, via a discharging electrode r' of this rotor r.

The inventors have already proposed a technique for suppressing noise by introducing the hollow insulating member into the distributor of FIG. 2. A basic conception of the proposed distributor is as follows. That is, the hollow insulating member is located in the discharging air gap AG, formed between the discharging electrode r' of the rotor r and the discharging electrode of the stationary terminal ST, and the spark discharge occurs by way of a through hole, formed inside the hollow insulating member, between the electrode r' and the electrode of the stationary terminal ST. The reason why the noise can be suppressed due to the presence of said through hole, is not completely clear. However, the following reason is considered to be reasonable. That is, when an initial discharge occurs between the electrodes, an atmospheric air around the electrodes, including oxygen ($O_2$) gas and nitrogen ($N_2$) gas, is activated. Thereby, the oxygen ($O_2$) and the nitrogen ($N_2$) are transformed into activated molecules such as ozone ($O_3$) and nitride oxides ($NO_x$), respectively. In the typical conventional distributor, such activated molecules ($O_3$, $NO_x$) are spread uniformly therein. However, such activated molecules are not liable to spread uniformly inside the distributor, because the activated molecules are kept inside the through hole of the hollow insulating member. Therefore, the air in the through hole is left in a condition in which the spark discharge is very liable to occur. Consequently, the level of the discharge voltage can considerably be reduced, even though the spark gap is selected to be wider than 6.35 mm employed in the previously mentioned first prior art example. It should be noted that the reduction of the level of the discharge voltage results in the suppression of noise. In this case, it is very important to know that the suppression of noise is not so remarkable if the level of the discharge voltage is reduced merely by shortening the distance of the spark gap, formed between the electrodes. However, such suppression of noise can be remarkable if the level of the discharge voltage is reduced without shortening the distance of the spark gap.

Figure 3A:
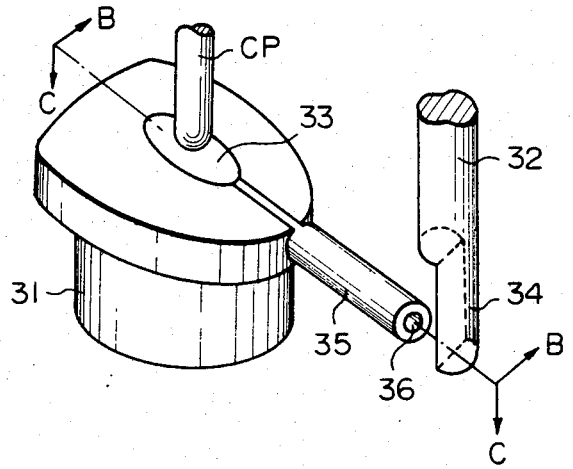
FIG. 3A is a perspective view showing an arrangement of the distributor on which the present invention is based.
Figure 3B:
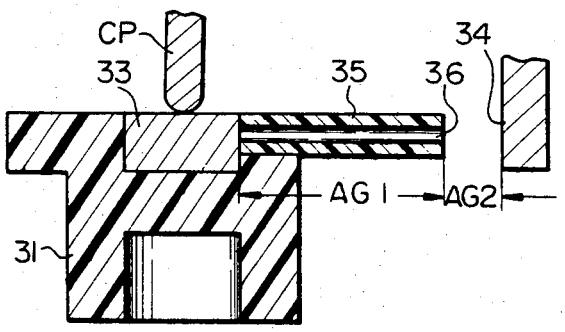
FIG. 3B is a cross-sectional view taken along the line B—B shown in FIG. 3A.
Figure 3C:
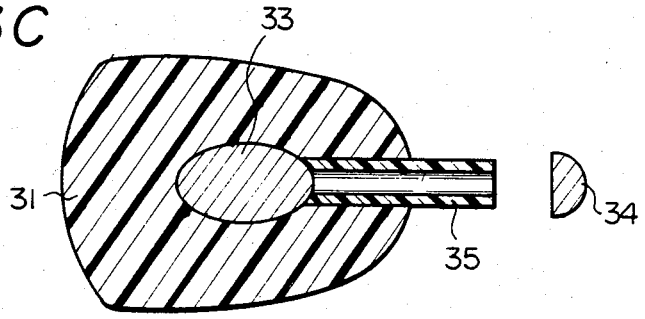
FIG. 3C is a cross-sectional view taken along the line C—C shown in FIG. 3A.

FIG. 3A is a perspective view of a basic structure, according to the above mentioned basic conception, on which the distributor, having the hollow insulating member, of the present invention is based. While, FIGS. 3B and 3C are cross-sectional views taken along the lines B—B and C—C shown in FIG. 3A, respectively. In FIGS. 3A, 3B and 3C, the reference numeral 31 represents a distributor rotor (see the member r shown in FIG. 2), the reference numeral 32 represents a stationary terminal (see the member ST shown in FIG. 2), and the reference symbol CP represents the center piece. The distributor rotor 31, made of an insulating material, is provided with a discharging electrode 33, made of a conductive material. In this case, a discharging electrode having the shape of long strip, such as the discharging electrode r' shown in FIG. 2 is not used, but the center piece CE shown in FIG. 2 simultaneously acts as such discharging electrode is used. The above mentioned hollow insulating member 35 is inserted in the discharging air gap (see the portion AG in FIGS. 1 and 2). This discharging air gap is formed between the discharging electrode 33 (corresponding to said center piece CE) and a discharging electrode 34 of the stationary terminal 32. A through hole 36 is formed in the hollow insulating member. Thus, the spark discharge occurs between the discharging electrodes 33 and 34 by way of, in FIG. 3B, the discharging air gap AG1, defined by the through hole 36, and the discharging air gap AG2 which corresponds to the typical conventional discharging air gap. Consequently, a total discharging gap distance (AG1+AG2) becomes longer in distance, for example 6.8 mm, than that of the previously mentioned first prior art example, such as 6.35 mm. However, it should be noted that the level of the discharge voltage is not so increased, compared to that of the first prior art example, and thereby the noise can considerably suppressed.

Figure 4A:
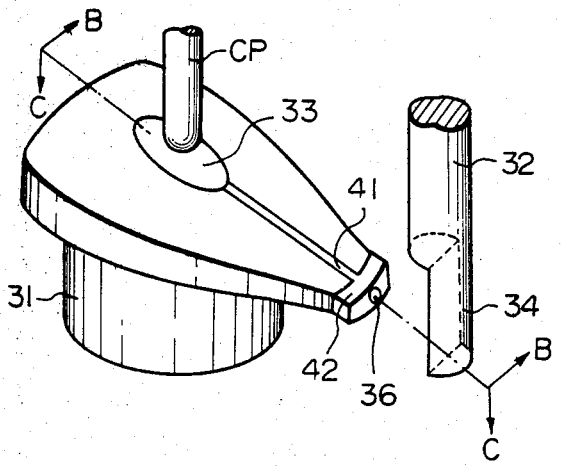
FIG. 4A is a perspective view showing a first embodiment according to the present invention.
Figure 4B:
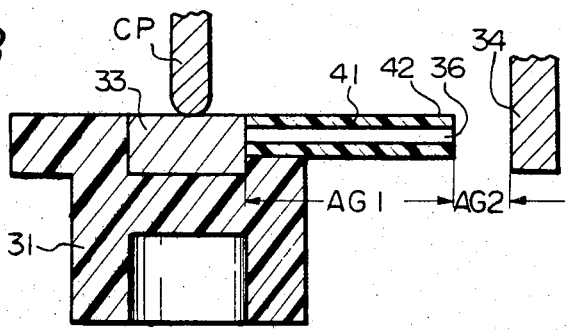
FIG. 4B is a cross-sectional view taken along the line B—B shown in FIG. 4A.
Figure 4C:
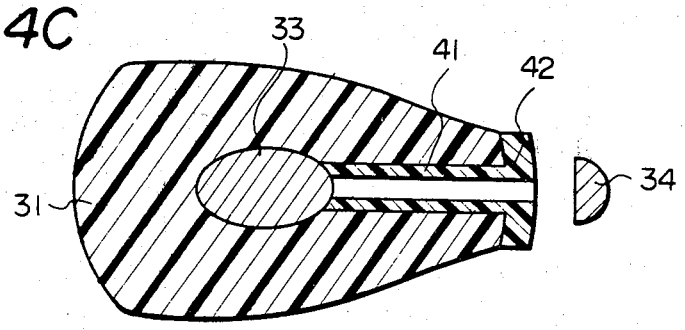
FIG. 4C is a cross-sectional view taken along the line C—C shown in FIG. 4A.
Figure 5:
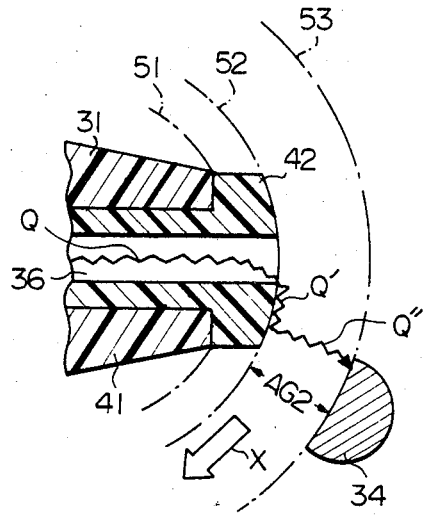
FIG. 5 is an enlarged cross-sectional view, partially cut off, used for explaining the behavior of a spark discharge occurring between a discharging portion 42 and a discharging electrode 34 shown in FIG. 4C.

However, as previously mentioned, in the distributor shown in FIGS. 3A, 3B and 3C, improvement on the advance angle has not yet been fully examined. Accordingly, the spark discharge occurring in such distributor is not actually sufficient to follow within a wide range of a variation of the advance angle by which the ignition timing of each spark plug PL is defined. In order to achieve the above mentioned improvement, the present invention provides a distributor such as shown in FIGS. 4A, 4B and 4C. FIG. 4A is a perspective view showing a first embodiment according to the present invention, and FIGS. 4B and 4C are cross-sectional views taken along the lines B—B and C—C shown in FIG. 4A, respectively. As seen from FIGS. 4A and 4C, the hollow insulating member 41 of the present invention has, at an open end, facing the discharging electrode 34, of the through hole 36, an arc-shaped discharging portion 42. FIG. 5 is an enlarged cross-sectional view, partally cut off, used for explaining the behavior of the spark discharge occurring between the arc-shaped discharging portion 42 and the discharging electrode 34. In FIG. 5, the spark discharge Q first runs along and in the through hole 36 then runs along the surface of the arc-shaped discharging portion 42 and finally reaches, via the discharging air gap AG2, the discharging electrode 34. The spark discharge Q acts as a creeping discharge Q' on the arc-shaped outer surface. The creeping discharge Q' can be transformed into an aerial spark discharge Q" at any position on the arc-shaped outer surface, in accordance with the value of the advance angle, during the rotation of the discharging portion 42 along the arrow X. In this case, it is desired to form the aerial spark discharge Q" with a constant distance of the discharging air gap AG2 at any position on the outer surface of the portion 42. Therefore, the arc of the discharging portion 42 is formed to be concentric with respect to a circular locus 51 of the distributor rotor. The expanded arc of the discharging portion 42 may be expressed by a curve indicated by a chain dotted line 52. On the other hand, the surface, facing the discharging portion 42, of the discharging electrode 34 is also formed to be concentric, as shown by a chain dotted line 53, with respect to the above mentioned circular locuses 51 and 52.

Figure 6:
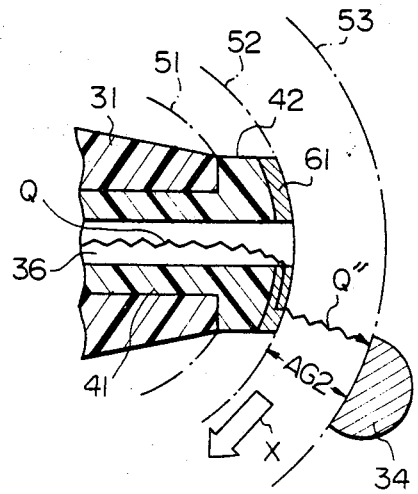
FIG. 6 is an enlarged cross-sectional view, partially cut off, showing a structure of a second embodiment according to the present invention; and, FIG. 7 is a graph depicting changes of the noisefield intensity level produced from actual vehicles, in which the distributors according to the first and second embodiments of the present invention and that of the prior art are mounted, respectively.

Thus, the distributor shown in FIG. 5 can cope with any advance angle due to the creation of the creeping discharge formed on the arc-shaped outer surface of the discharging portion 42 which is concentric with respect to the circular locus of the distributor rotor. However it should be noted that the technique for guiding the spark discharge Q from the through hole to the arc-shaped outer surface, is not restricted to the above mentioned technique. FIG. 6 is an enlarged cross-sectional view, partially cut off, showing a structure of a second embodiment according to the present invention. In FIG. 6, a conductive layer 61 is further formed onto the arc-shaped outer surface of the discharging electrode 42. The spark discharge Q of the through hole 36 can be guided onto the arc-shaped outer surface with the aid of the conductive layer 61. Consequently, the spark discharge Q is directly transformed into the aerial spark discharge Q", along the air gap AG2, at any position on the arc-shaped outer surface, in accordance with the value of the advance angle, during the rotation of the discharging portion 42 along the arrow X. It should be understood that the behavior of the spark discharge, shown in each of FIGS. 5 and 6, is an actual illustration of a film taken by a high speed motion picture camera.

In the above mentioned first and second embodiments, regarding material for making the hollow insulating member, the hollow insulating member is made of an insulating material, preferably ceramic, glass or synthetic resin, most preferably ceramic. In the example of the present invention, a ceramic, having a trade name of MACHOL, produced by the Corning Glass Works, is used, in which the ceramic has a resistance value of $10^{14}$ Ωcm being substantially the same as that of glass which conventionally has the resistance value of $10^{15}$ Ωcm.

Regarding materials for making the rotor 31 and the hollow insulating member 41, it is not necessary to make them from different materials shown in each of FIGS. 4A, 4B, 4C, 5 and 6. That is, in each of these Figures, the rotor and the hollow insulating member are made of different materials and fixed together by means of suitable adhesive materials (not shown). However, in view of a mass production process, it is preferable to fabricate both the rotor and the hollow insulating member, as one body, by using the same material through an integral forming process.

Figure 7:
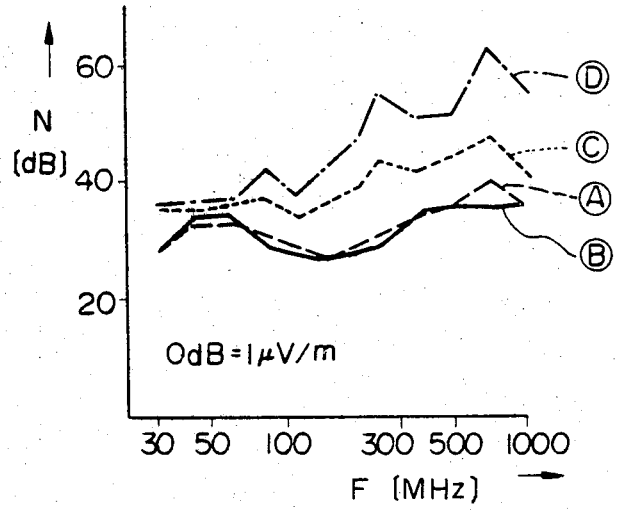

In the second embodiment, the conductive layer 61 may be produced through various kinds of known methods. Taking as an example, metal grains, such as copper grains, which are fixed on the arc-shaped outer surface of the discharging portion 42, through a projection process, plating process, adhesion process or surfacing process. The inventors have achieved experiments on the noise-field intensity level, wherein the distributor is mounted in an actual vehicle, and they found the following resultant data. FIG. 7 depicts a graph indicating the resultant data of said experiments. In the graph of FIG. 7, the abscissa indicates an observed frequency F in MHz and the ordinate indicates the level of the noise-field intensity N in dB, in which 0 dB corresponds to 1 μV/m. In the graph, a curve Ⓐ represents the characteristics of the noise-field intensity, measured by using an actual vehicle which mounts a distributor of the first embodiment shown in FIGS. 4A, 4B, 4C and 5. Similarly, a curve Ⓑ represents the characteristics, measured by using actual vehicles which mount a distributor of the second embodiment shown in FIG. 6. Curves Ⓒ and Ⓓ are also depicted therein, only for the sake of comparison with prior arts. The curve Ⓒ represents the characteristics of the noise-field intensity, measured by using an actual vehicle which mounts a distributor of the previously mentioned second prior art (using an electrically high resistive material layer), the curve Ⓓ represents the characteristics of the noise-field intensity, measured by using an actual vehicle which mounts a typical and conventional distributor shown in FIG. 2. As understood from the graph of FIG. 7, the capability for suppressing noise can still be maintained at a high level, even though the means for coping with a variation of the advance angle is incorporated into the proposed distributor shown in FIGS. 3A, 3B and 3C. Further, remarkable difference in capability for suppressing noise, between the characteristics of the curves Ⓐ and Ⓑ relating, respectively to the first and second embodiments, cannot be found in the graph. However, the second embodiment (FIG. 6) may be better than the first embodiment (FIG. 5) in view of an ability for saving energy consumption. That is, in the second embodiment, the level of voltage, supplied from the ignition coil I (FIG. 1) can be reduced, compared with the case where the distributor of the first embodiment is used, which voltage must be at some level so as to apply always a predetermined discharging voltage between the discharging electrode 33 of the distributor rotor and the discharging electrode 34 of the stationary terminal. This is because, in the first embodiment, the level of said voltage is lowered by a voltage drop which is developed across a discharging resistance of the creeping discharge Q' (FIG. 5) occurring along and on the arc-shaped outer surface of the discharging portion 42. Contrary to the above, in the second embodiment, such a voltage drop cannot be developed due to the presence of the conductive layer 61 (FIG. 6). According to an experiment, the voltage level, supplied from the ignition coil I, when the second embodiment is employed, is lower than that of the case where the first embodiment is employed, by about several kV.

As explained above in detail, the proposed distributor having the hollow insulating member is improved due to the fact that the spark discharge can follow within a wide range of a variation of the advance angle, without reducing the capability for suppressing noise.

We claim:

1. A distributor for an internal combustion engine, comprising an apparatus for suppressing noise within a wide range of advance angles, said distributor comprising:

a rotor made of insulating material having a first discharging electrode and being rotated by a driving shaft of the internal combustion engine;

a plurality of stationary terminals fixed to an insulating support member, each stationary terminal provided with a second discharging electrode, said stationary terminals arranged around a circular locus with said rotor at the center of the circular locus, each of said second discharging electrodes being separated from said first discharging electrode by a discharging air gap through which a spark discharge is generated;

said apparatus for suppressing noise comprising means for preventing the random motion of combustible gaseous molecules in said discharge gap when said spark discharge is generated, said apparatus for suppressing noise comprising a tubular insulating member having a first end secured in abutment with said first discharging electrode and a second end extending into said discharge gap;

said tubular member forming a cylindrical passage in said discharge gap through which said spark discharge passes;

said second end of said insulating member being arc-shaped, said arc-shaped second end being concentric with said circular locus.

2. A distributor as set forth in claim 1, wherein the outer surface of said arc-shaped second end is covered by a conductive layer.

3. A distributor as set forth in claim 1, wherein said insulating member including said arc-shaped second end is made of ceramic.

4. A distributor as set forth in claim 2, wherein said insulating member including said arc-shaped second end is made of ceramic.

5. A distributor as set forth in claim 1, wherein said insulating member including said arc-shaped second end is made of glass.

6. A distributor as set forth in claim 2, wherein said insulating member including said arc-shaped second end is made of glass.

7. A distributor as set forth in claim 1, wherein said insulating member including said arc-shaped second end is made of synthetic resin.

8. A distributor as set forth in claim 2, wherein said insulating member including said arc-shaped second end is made of synthetic resin.

9. A distributor as set forth in claim 2, 4, 6 or 8, wherein said conductive layer is produced by applying metal grains onto said arc-shaped second end of said insulating member by a projection, plating, adhesion or surfacing process.

* * * * *